US006702108B2

(12) United States Patent
Lo Duca

(10) Patent No.: US 6,702,108 B2
(45) Date of Patent: Mar. 9, 2004

(54) BOX WITH POCKET FOR EXTRACTABLE LEAFLET

(75) Inventor: Carmelo Lo Duca, Milan (IT)

(73) Assignee: GI. BI. Effe S.r.l., Milan (IT)

( * ) Notice: Subject to any disclaimer, the term of this patent is extended or adjusted under 35 U.S.C. 154(b) by 0 days.

(21) Appl. No.: 10/263,847

(22) Filed: Oct. 4, 2002

(65) Prior Publication Data

US 2003/0146118 A1 Aug. 7, 2003

(30) Foreign Application Priority Data

Oct. 23, 2001 (IT) ..... MI2001A2214

(51) Int. Cl.[7] ..... B56D 69/00
(52) U.S. Cl. ..... 206/232; 229/120.18
(58) Field of Search ..... 206/232, 831; 229/120.08, 120.15, 120.18, 120.37, 122.32

(56) References Cited

U.S. PATENT DOCUMENTS 3,147,856 A * 9/1964 Lightner et al. ..... 206/232
4,125,185 A * 11/1978 Bliss ..... 229/120.18
5,078,268 A 1/1992 Olson et al.
5,513,752 A * 5/1996 Gottlieb ..... 206/232
5,944,183 A * 8/1999 Rowland et al. ..... 206/232
6,070,719 A * 6/2000 Pollock ..... 206/232

FOREIGN PATENT DOCUMENTS

| | | |
|---|---|---|
| DE | 32 08 777 | 9/1983 |
| EP | 1 219 542 | 7/2002 |

* cited by examiner

*Primary Examiner*—Luan K. Bui
(74) *Attorney, Agent, or Firm*—Oblon, Spivak, McClelland, Maier & Neustadt, P.C.

(57) ABSTRACT

A box formed from a single piece of cardboard defining in its interior a pocket into which an illustrative leaflet or the like is inserted during the manufacture of the box which, advantageously, is shaped in such a manner as to facilitate the insertion of the products to be contained in the box and to enable the leaflet to be easily extracted from the already finished box.

10 Claims, 5 Drawing Sheets

BOX WITH POCKET FOR EXTRACTABLE LEAFLET

FIELD OF THE INVENTION

The present invention relates to a box formed from a single piece of cardboard and defining in its interior a pocket into which, during the manufacture of the box, a leaflet can be inserted illustrating the product which is later to be placed therein by the firm which utilizes the box. The term "illustrative leaflet" means any sheet, possibly folded several times on itself, carrying writing and instructions relative to the product contained in the box, or a card extractable from the pocket and having images or writing of any type reproduced on it.

Many products or articles are housed, preserved and transported in boxes or holders normally made of cardboard. Very often, illustrative leaflets or the like are also inserted into these boxes. A frequent case is that in which the articles or products inserted into the boxes are containers of various kinds, bottles, or flat packs defining a plurality of recesses containing pharmaceutical products: in this case, the leaflets illustrating the pharmaceutical product must compulsorily be present in the actual boxes into which the bottles, containers or the like are inserted.

In the usual known art, the boxes are produced by specialist firms, the pharmaceutical industry (or another box user) then directly inserting the bottles or the like into them together with the illustrative leaflets: this operation is relatively laborious and slow, especially as a result of the difficulties encountered in inserting the leaflet (often of large dimensions and folded over several times) into the box in such a manner that it still allows the bottle to be freely inserted without the leaflet becoming creased.

BACKGROUND OF THE INVENTION

To obviate these problems boxes have been proposed formed from a single piece of cardboard and defining in their interior a pocket into which the illustrative leaflet is inserted directly by the manufacturer of the box, the user of which has then merely to insert the articles (bottles or others) which the box is to contain.

The leaflet must be retained securely inside each box so that it does not interfere with the article inserted into the box by the user. Moreover, the box must be of such a structure that the illustrative leaflet can be inserted very easily and quickly by the box manufacturer, directly during the box forming process.

DESCRIPTION OF RELATED ART

GB-A-2277077 (see FIGS. 3 and 4) and DE-A-3208777 (see FIG. 2) describe boxes, into the interior of which there projects a flap which on one of its sides is rigid with one of the main side walls of the box, this flap facing a different main wall of the same box to form therewith a pocket housing the illustrative leaflet. These boxes are not usable industrially because the flap which defines the pocket is connected to the box structure only along one side, so that the flap can freely flex (i.e. "open") towards the interior of the box, so preventing mechanical insertion thereinto of bottles or other product packs to which the leaflet refers.

U.S. Pat. No. 3,147,856 (FIG. 3) and EP-A-0911266 (FIG. 2) describe boxes similar to those of the two aforementioned patents, but in which the flap defining the pocket in the box interior has its free end folded at 90° on itself to form a tab (indicated by the reference numeral 42 in U.S. Pat. No. 3,147,856 and 16 in EP-A-0911266) which is glued to the adjacent main said wall of the box.

These boxes present serious drawbacks, in that as the said tab has to be glued to the main wall during the production of the boxes, which are despatched to the user firms as packs of identical boxes flattened together, it becomes impossible to produce such boxes. To better understand this problem, it will be assumed that the boxes of FIG. 3 of U.S. Pat. No. 3,147,856 and of FIG. 2 of EP-A-091126 have to be flattened together (as shown in FIG. 2 of U.S. Pat. No. 3,147,856) in order to be stacked and despatched to the user. If the tabs 42 and respectively 16 of the two boxes are glued to the adjacent main surfaces of the boxes, it is impossible to flatten the boxes without damaging them. Likewise, the boxes cannot be opened from their flattened condition to their formed condition ready for insertion of the products which they are to contain.

Vice versa, if the tabs 42 and respectively 16 are not glued, the same problems arise as stated for the two aforestated and already discussed patents.

Another problem of boxes with glued tabs consists of the fact that for their formation, the boxes require glue to be applied in different regions at successive times, thus slowing down production and increasing costs.

SUMMARY OF THE INVENTION

The main object of the present invention is to provide a box formed from a single piece of cardboard and defining a pocket for housing an extractable leaflet, in which the box is of very simple structure and construction and especially in which said pocket is defined by a main panel of the box itself and a supplementary panel which is prevented from overturning into the interior of the box by a tab forming part of the box itself.

This and further objects are attained by a box having the characteristics specified in the ensuing claim 1.

Preferably, the width of the tab of the supplementary panel and the width of the last main panel are less than the width of the main panel on which said tab is superposed in the final box.

A common requirement of all boxes of the aforesaid known type is to enable the final box user to easily withdraw the illustrative leaflet from and reinsert it into the box such that the leaflet can remain enclosed and protected within the box when its closure panel is closed.

To satisfy this requirement, WO 0020289 describes a box with an external pocket housing an illustrative leaflet which can be withdrawn from and reinserted into the pocket without having to open the box closure panels; this box has a necessarily greater volume than that required to protect the product which the box is intended to contain and protect, and moreover the leaflet can fall out of the pocket (and hence be lost) or can be withdrawn while the box is still closed and sealed.

GB-A-2277077 describes a box with an internal pocket housing the illustrative leaflet which can be withdrawn by removing a portion of a side wall of the box, in order to free an aperture positioned in correspondence with one of the ends of the leaflet, which can hence be withdrawn from the box even without opening its end panels; such a construction, after the removal of the said portion of its side wall, weakens the mechanical strength of the box, leaves the leaflet always visible, and makes reinsertion of the leaflet into the pocket very difficult, especially if the leaflet is of large dimensions and is folded several times on itself. Finally, as a portion of at least one side wall of the box has to be removed to withdraw the leaflet, writing relative to the product contained in the box cannot be printed on that portion, this representing a serious drawback because boxes of this type are of relatively small dimensions, their entire surface being used to print writing of various kinds.

EP-A-0911266, U.S. Pat. No. 3,099,381 and U.S. Pat. No. 3,147,856 describe boxes housing in their interior illustrative leaflets which can be withdrawn by tearing off a substantial part of a side wall, to hence completely free the leaflet which can be easily withdrawn but cannot then be rehoused, retained and preserved within the pocket which is no longer reclosable. There is also the aforesaid problem, i.e. that an entire side wall of the box cannot be used in practice for carrying writing which must always be readable by the box user, even after the leaflet has been withdrawn.

An object of the present invention is therefore to provide a box of the aforesaid type from which the leaflet can be withdrawn from its pocket and then be easily reinserted therein when the closure panel or lid is in the open or raised position, the entire outer surface of the box being usable for applying writing visible at all moments and in any condition.

These preferential objects are attained by a box having the characteristics specified in the accompanying claims from 3 to 5.

Known boxes present the drawback that when the user firm inserts the article which the box is to contain, using automatic machines operating at high speed, the article interferes with the illustrative leaflet or with the free edge of the supplementary panel which defines the pocket provided therein, in correspondence with that end or aperture of the box through which the article is inserted, with serious and obvious operational consequences.

A further object of the present invention is therefore to provide a box of the aforesaid type provided with elements which prevent the articles inserted into the box from interfering with the free edge of the panel defining the pocket and with the leaflet housed in the pocket.

This further object is attained by a box having the characteristics specified in the ensuing claims 6 to 9.

A hole is preferably provided in the panel defining said pocket to enable a portion of the illustrative leaflet housed in the box to be seen.

The invention also relates to the sheets in the form of a single piece of punched and crease-lined cardboard or the like, usable for forming boxes of the aforedefined type.

Figure 1:
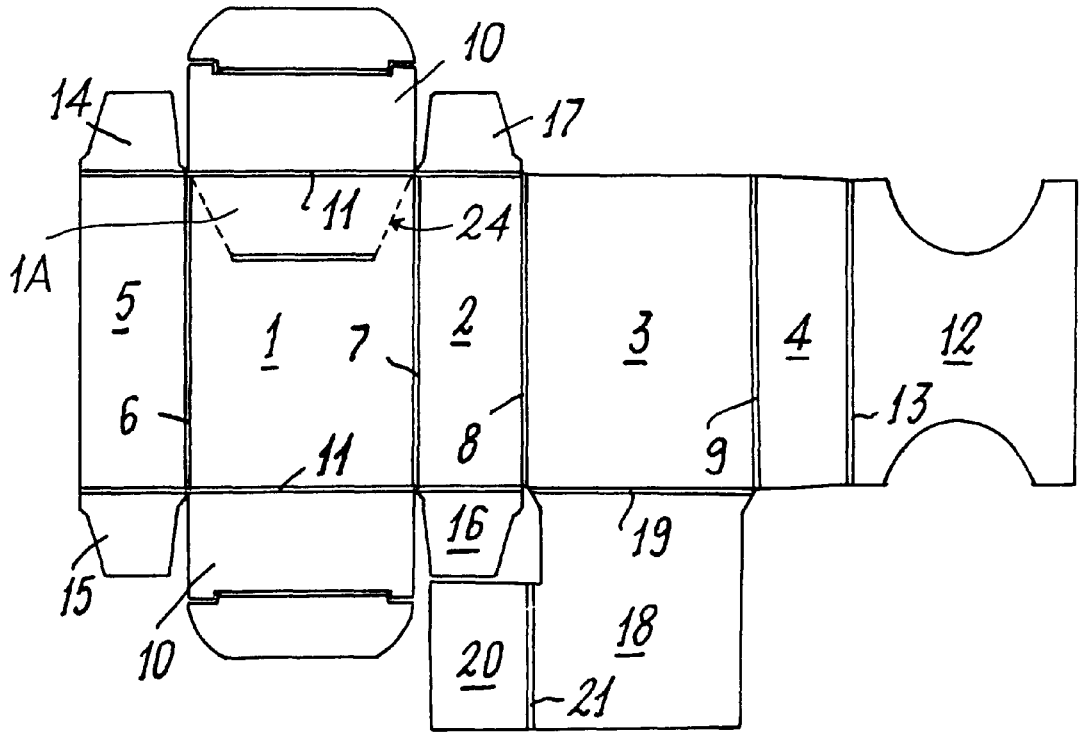
FIG. 1 is a plan view of a spread-out punched and crease-lined piece of cardboard usable for forming a box, the figure showing that surface of the cardboard which is to remain on the inside of the box.
Figure 6:
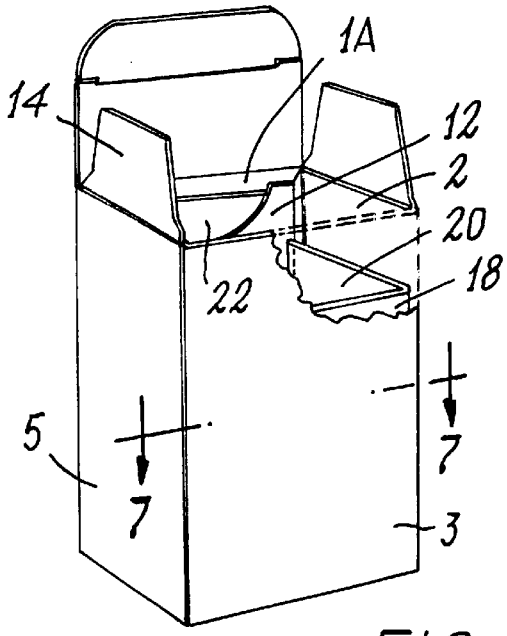
Figure 7:
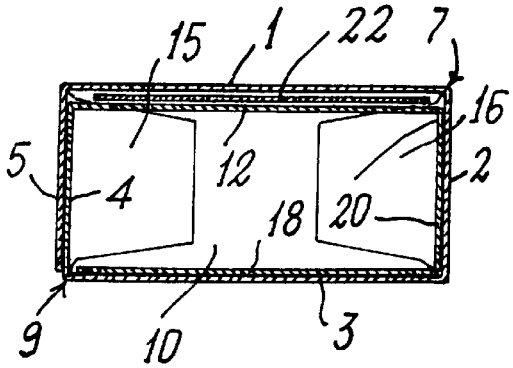

FIGS. from 2 to 5 show the piece of cardboard of FIG. 1 in its successive folding steps to form the box;

FIG. 6 is a perspective view of the finished box with its upper lid open, a portion of the box having been omitted to allow clearer vision of its interior;

FIG. 7 is a cross-section through the box on the line 7—7 of FIG. 6.

Figure 5:
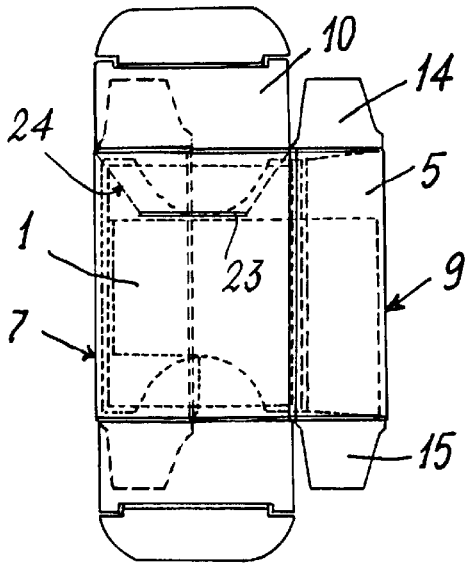
Figure 8:
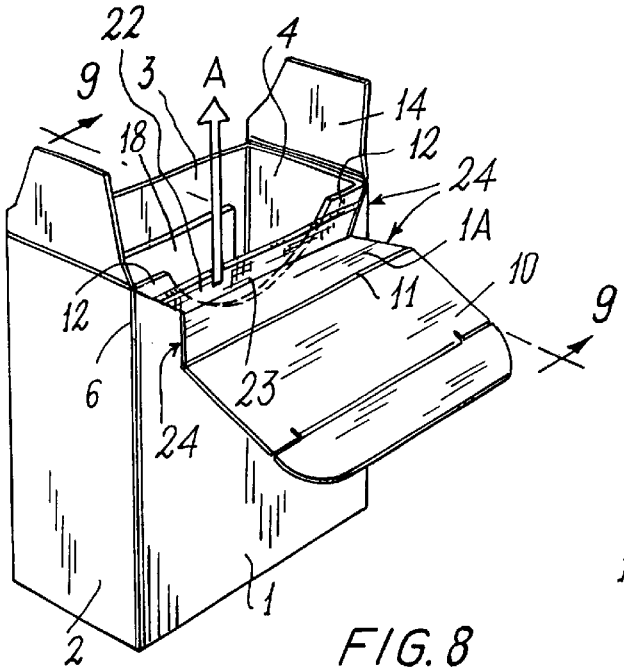
Figure 9:
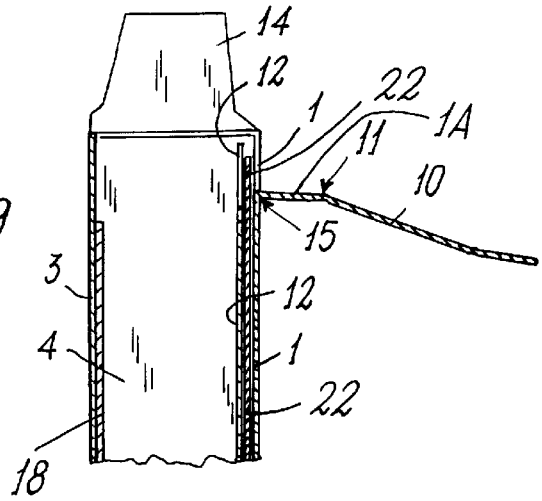
Figure 10:
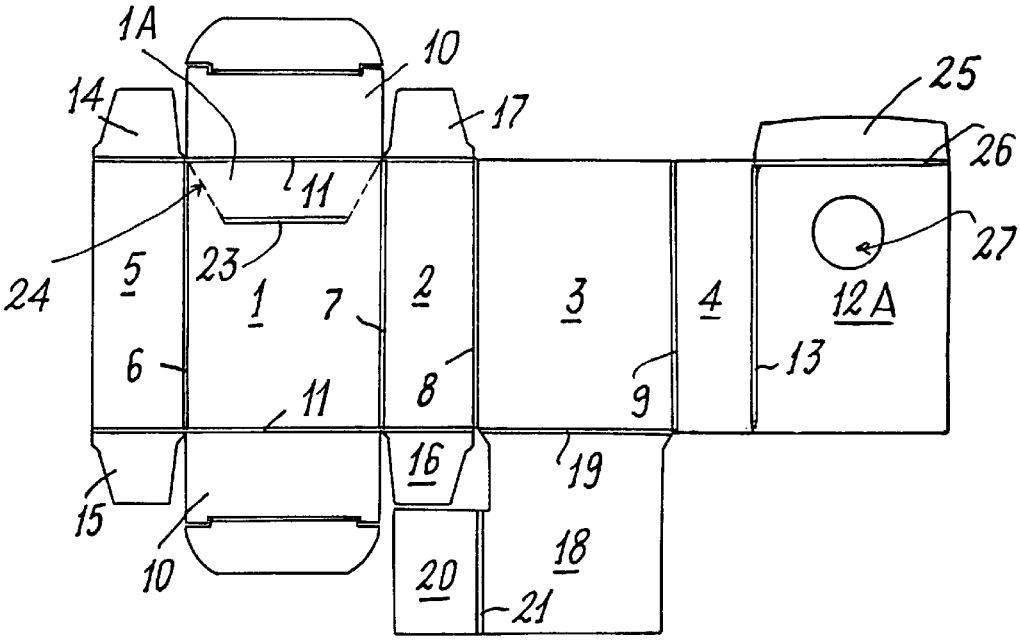
Figure 11:
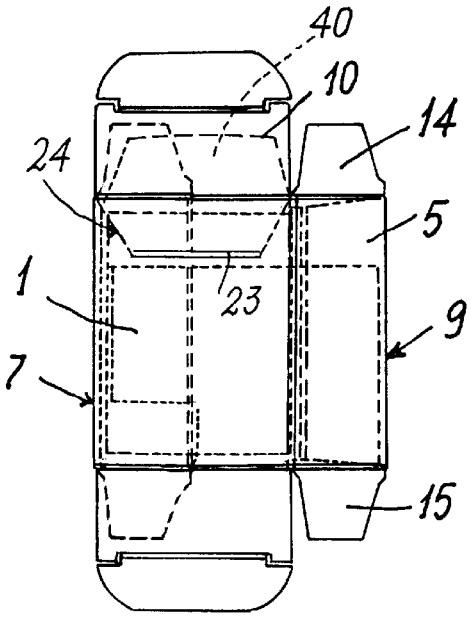
Figure 12:
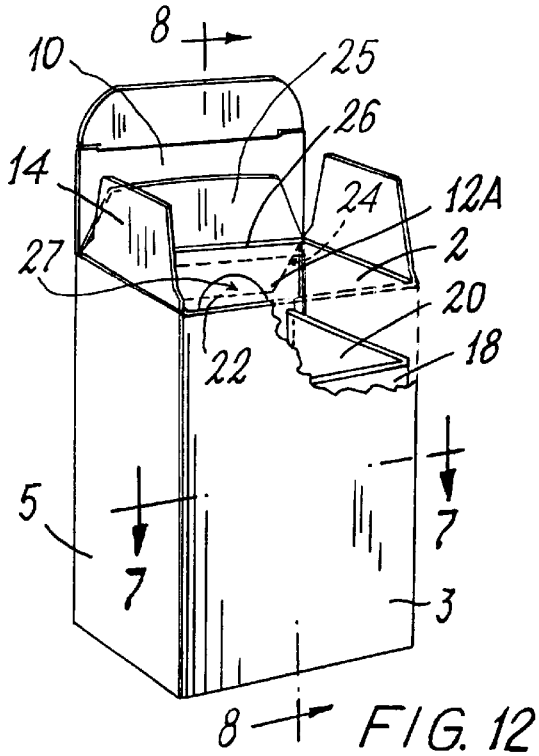
Figure 13:
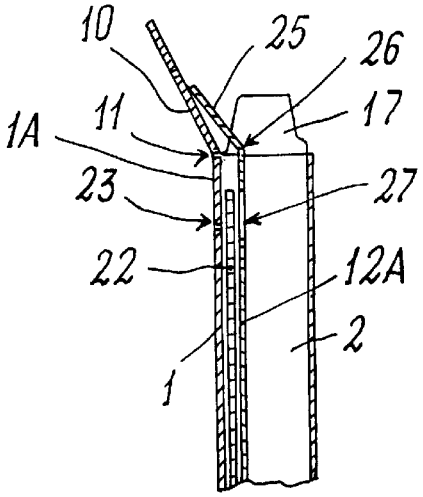

FIG. 8 is a perspective view similar to FIG. 6, but seen from the other side of the box and with its lid turnable outwards to enable an illustrative leaflet housed in the box to be extracted therefrom;

FIG. 9 is a longitudinal section through the box on the line 9—9 of FIG. 8;

FIG. 10 is similar to FIG. 1 and shows in plan view a piece of cardboard usable to form a box different from that shown in the preceding figures; and FIGS. 11, 12 and 13 are similar to FIGS. 5, 6 and 7, but refer to a box formed from the piece of cardboard of FIG. 10.

DETAILED DESCRIPTION OF THE INVENTION

Reference will firstly be made to FIG. 1, which shows a spread-out piece of punched, crease-lined and knurled cardboard seen from its inner side, i.e. the opposite side to that on which the descriptive matter which has to be visible on the outside of the finished box is printed.

The cardboard piece comprises four consecutive main panels 1–4 and a flap 5 projecting from the first of the main panels, i.e. from the panel 1; the said panels and flap are separated one from another by longitudinal parallel folding lines 6–9. From the two opposite ends of the main panel 3 there project two closure panels 10 (separated from the main panels by transverse folding lines 11 perpendicular to the folding lines 6–9) intended to form the lid (i.e. the top) and respectively the base of the box, whereas from opposing sides of the flap 5 and main panel 2 there project closure tabs 14–17.

From the last of the main panels, i.e. from the panel 4, there projects a supplementary panel 12 separated from said panel 4 by a longitudinal folding line 13 parallel to the lines 6–9. From the drawings it can also be seen that the total width of the supplementary panel 12 is substantially equal to or slightly less than the width of the two main panels 1 and 3.

In the embodiment shown in FIG. 1, the two free edges, i.e. the upper and respectively lower (with respect to the drawings) edge, of the supplementary panel 12 are profiled, i.e. defined by an arched line, to facilitate insertion into the finished box of the product which it is intended to contain, and facilitate extraction of the illustrative leaflet described hereinafter.

The structure of the punched and crease-lined cardboard piece described up to this point is known.

The main characteristic of the cardboard piece according to the invention (and of the box which can be formed from it) consists of the fact that from the penultimate main panel, i.e. the panel 3, there downwardly (with respect to FIG. 1) projects a supplementary panel 18 separated from it by a folding line 19 transverse to the longitudinal folding lines 6–9 and 13 and that from this supplementary panel 18 there projects (towards the first main panel 1, i.e. towards the left in FIG. 1) a tab 20 separated from it by a longitudinal folding line 21.

Another characteristic apparent from the drawings is that in the panel 1 there are provided both a transverse folding line 23 (shorter than the folding lines 11 and positioned between them) and a pair of tearable knurlings 24 which extend between the ends of the upper folding line (with respect to the drawing) 11 and the folding line 23, to define a portion 1A of the main panel 1.

It will now be assumed that the cardboard processing firm which has produced the punched and crease-lined cardboard sheet of FIG. 1 then folds it in order to form from it the box to be despatched to the box user.

Figure 2:
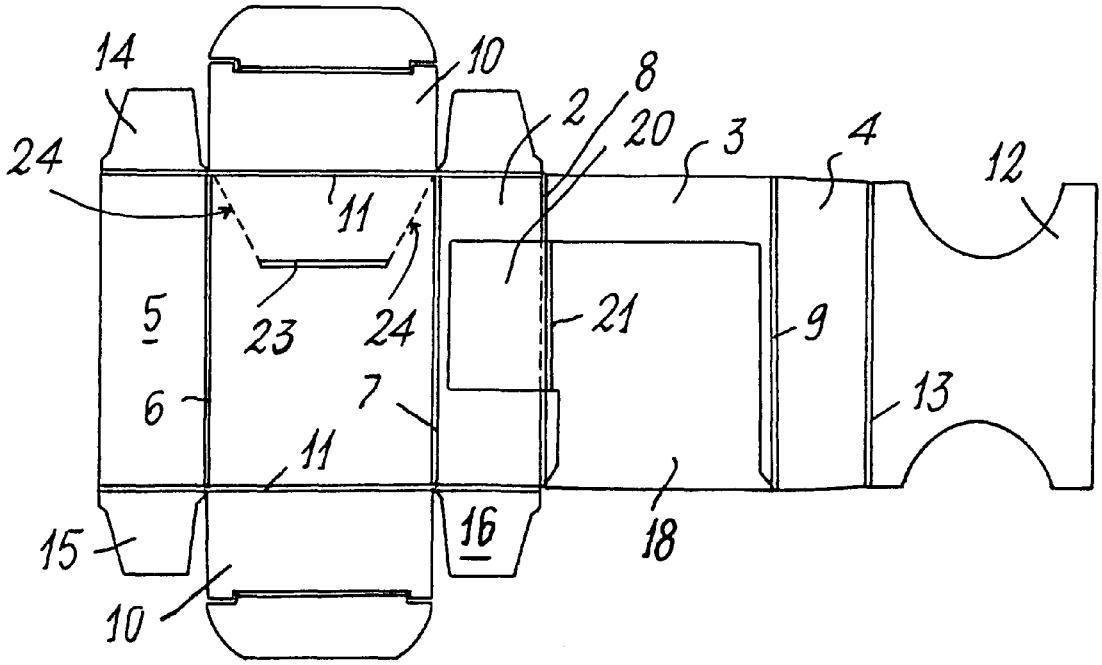
Figure 3:
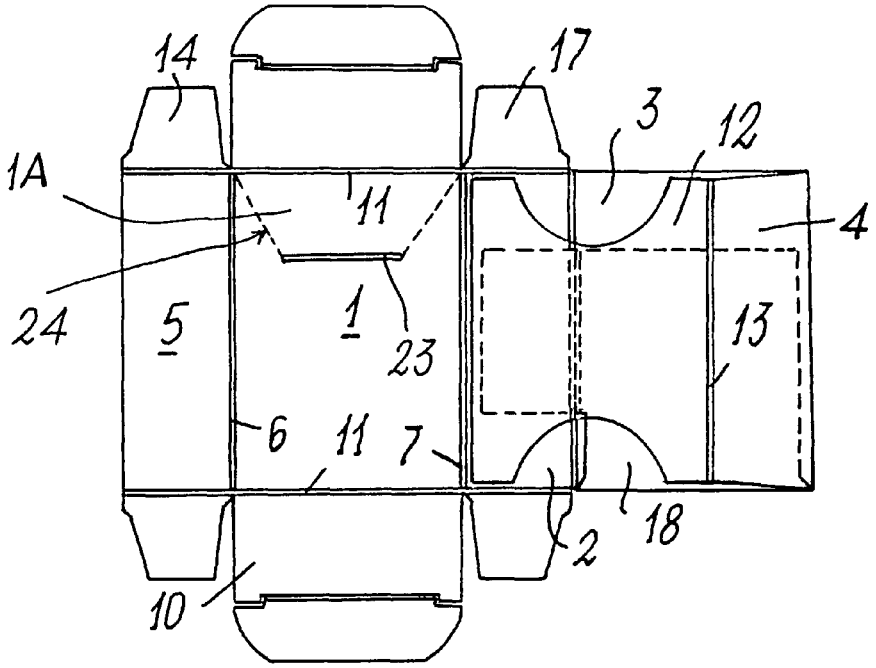
Figure 4:
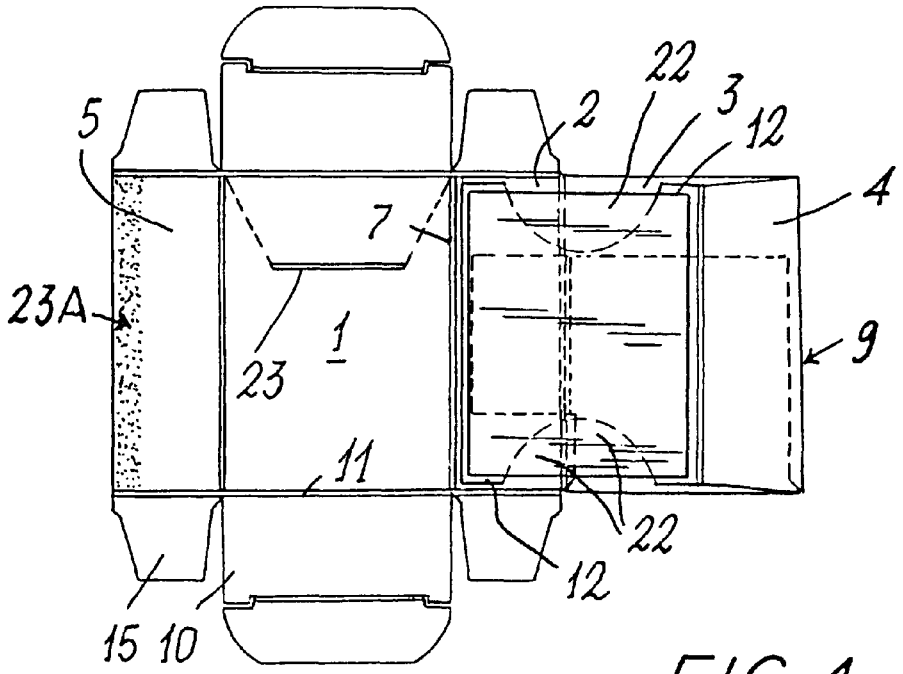

In a first step, the supplementary panel 18 is folded (by rotating it about the folding line 19) onto the penultimate main panel 3, with the tab 20 lying on the main panel 2 adjacent to the panel 3 and positioned (relative thereto)

towards the main panel 1, as shown in FIG. 2. The main panel 4 together with the end panel 12 are then folded about the folding line 9 onto the supplementary panel 18 and the tab 20 (FIG. 3), after which an illustrative leaflet, previously printed and possibly folded on itself, is (automatically) rested on the upper surface of the end panel 12 and one or more lines of glue 23A are applied to the panel 5 (FIG. 4), and finally the main panel 1 (and with it the flap 5) is folded about the folding line 7 so that the panel 1 lies superposed on the leaflet 22 and on the underlying end panel 12, whereas the flap 5 lies superposed on the main panel 4 onto which it is fixed by the line of glue 23A (FIG. 5).

Under these conditions the leaflet 22 is housed and retained in a pocket defined by the end panel 12 and the main panel 1.

All the aforedescribed operations can be effected rapidly and easily by those cardboard processing firms who produce traditional boxes, employing those automatic machines commonly used by said firms.

The user firm which receives the box already glued and folded as shown in FIG. 5 then uses its automatic machines of normal use to shape the box and close the base panel while leaving the upper closure panel 10 and the tabs 14 and 17 raised, i.e. open, after which it inserts into the box the article which it is intended to house. For example, if the user firm produces pharmaceutical specialities, the article which it inserts into the box can consist of one or more packs (not shown in the drawings) of pharmaceutical tablets or capsules.

As the operation of inserting a bottle or another packaged product into the box can be carried out at high speed by known machines, the user firm has the great advantage of not having to also insert the illustrative leaflet (which is already contained in the internal pocket of the box) into the box and not having to take considerable care to prevent the bottle or other product (during its insertion into the box) from interfering with the leaflet, to deform and crush it.

On using the box of the invention, when it is squeezed to transform it from the condition of FIG. 5 to that of FIG. 6 (done by pressing against the two opposite corners, i.e. on the longitudinal-folding lines 7 and 9), the longitudinal free edge of the end panel 12 becomes positioned at the folding line 7 (causing the cardboard sheet to fold about the folding lines 6 and 13, which are mutually superposed) and over the longitudinal free edge of the tab 20 to maintain the panel 12 in a stable position and prevent it from flexing towards the interior of the box (even if the leaflet 22 housed in the pocket inside the box exerts pressure on the end panel 12). This is the main characteristic of the box of the invention in that the presence of the tab 20 on the supplementary panel 18 ensures that the leaflet-containing pocket maintains a constant shape and dimensions, even without the need to apply layers of glue (other than the already mentioned single layer of glue 23A).

It is also important to note that the transverse depth of the box pocket can be easily made of the desired value (to correctly house and retain leaflets of different thicknesses) by simply varying the width of the panel 4 and of the tab 20 to that desired value, as is apparent. In any event it is evident that the width of the panel 4 and of the tab 20 are preferably less than the width of the main panel 2 on which the tab 20 is superposed in the finished box.

To extract the leaflet 22 from the box, the lid or upper closure panel 10 of the box is overturned and pulled outwards to tear the panel 1 in correspondence with the knurlings 24 and bend the portion 1A of the panel 1 outwards, as shown in perspective view in FIG. 8 and in longitudinal section in FIG. 9; it will be immediately apparent that under these conditions it is very easy to grip the leaflet 22 with two fingers and to extract it (in the direction of the arrow A of FIG. 8) from the pocket of the box, into which the leaflet can be easily inserted again. The box can then be closed by rotating the portion 1A of the main panel about the folding line 23 and the panel 10 about the folding line 11 which divides it from said portion 1A of the panel 1.

Reference will now be made to FIGS. from 10 to 13 which show an embodiment of a box having some structural and operational characteristics equal to but others different from those already illustrated in FIGS. from 1 to 9. More specifically, the cardboard pieces (and the boxes formed therefrom) of the two embodiments differ only in the different shape of the supplementary panel which is indicated by the reference numeral 12 in FIGS. from 1 to 9 and with the reference numeral 12A in FIGS. from 10 to 13; all the other constituent parts of the two cardboard pieces and of the relative boxes are equal and, for simplicity and brevity of description, are indicated by the same reference numerals from 1 to 24 (with the exception of the reference numeral 12).

From the upper end of the panel 12A there projects a flap 25 separated from the panel 12A by a folding line 26 perpendicular to the folding lines 6–9, 13; from the drawings it can be seen that a hole 27 is provided in the panel 12A.

It will now be assumed that the cardboard processing firm which has produced the punched, crease-lined and knurled cardboard sheet of FIG. 10 then folds it and glues it in order to form from it the box to be despatched to the box user.

Proceeding exactly in the same manner and with the same succession of steps already described with reference to FIGS. from 1 to 5 (which it would be superfluous to repeat here), the glued and folded box (containing the illustrative leaflet 22) shown in FIG. 11 is obtained, it being totally similar to the box shown in FIG. 5.

The user firm which receives the box already glued and folded as shown in FIG. 11 then uses its automatic machines of normal use to shape the box and close the base panel while leaving the upper closure panel 10, the flap 25 and the tabs 14 and 17 raised, i.e. open and folded outwards from the box (as shown in detail in the longitudinal section of FIG. 13, which clearly shows the attitude assumed by the upper end of the box), and inserts into the box the article which it is intended to house.

It is of the maximum importance to note that, by virtue of the aforedescribed structure, the upper panel 10 and the flap 25 of the open box (FIG. 13) form a chute which facilitates the insertion of the said article into the box, while preventing the article interfering with the upper edge of the panel 12A and of the illustrative leaflet 22, which is thus securely protected within the box.

A portion of the leaflet (for example that portion on which the product identification bar codes are printed) enclosed in the box is visible through the hole 27 in the panel 12A.

As only a bottle or another article has to be inserted into the box, this can be done at high speed with known machines, without the user firm having normally to take particular care to prevent the bottle or other product (when being inserted into the box) from interfering with the leaflet 22 or with the upper edge of the panel 12A.

After the desired article has been inserted into the box, the upper box aperture is closed in the traditional manner with traditional machines. When the upper panel 10 is closed by rotation about its folding line 11, it automatically causes the flap 25 to turn over about its folding line 26.

To extract the leaflet 22 or the product enclosed and packaged in the box, the closed box is opened exactly in the same manner as already described with reference to FIGS. from 1 to 9.

What is claimed is:

1. A box formed from a single piece of punched and crease-lined cardboard or the like, defining an internal pocket for containing an extractable leaflet, comprising:

at least four consecutive main panels, a flap which projects from the first main panel and is superposed on and glued to the last main panel in the finished box, an end panel which projects from the last main panel and has a width substantially equal to that of the first main panel, to which it faces in the box interior to form with said first panel a pocket for containing said leaflet, at least one panel for closing at least one end of the box, the main panels, the end panel and said flap being separated one from the other by parallel longitudinal folding lines, wherein from the penultimate main panel there projects a supplementary panel separated from it by a folding line transverse to said longitudinal folding lines, from said supplementary panel there projecting a tab separated from it by a likewise longitudinal folding line, the supplementary panel and the tab projecting from it being folded into the box interior about their folding lines such that the supplementary panel and respectively said tab are superposed on the penultimate main panel and respectively on that main panel adjacent to it on the side towards the first panel, the main panels and also the end panel being folded about their longitudinal folding lines such that the end panel is superposed on the first main panel in the box interior to form therewith said pocket, while the free longitudinal edge of the end panel rests on the free longitudinal edge of the tab of the supplementary panel, which supports this end panel to prevent it from flexing towards the interior of the box.

2. A box with an internal pocket as claimed in claim 1, wherein the width of the tab of the supplementary panel and the width of the last main panel are less than the width of that main panel on which said tab is superposed in the finished box.

3. A box as claimed in claim 1, wherein in said main panel there are provided both a second transverse folding line and a pair of tearable cuts or knurlings which extend between the ends of the first transverse folding line and the second transverse folding line to enable the closure panel turned outwards and with it that portion of the first main panel which is bounded by the two transverse folding lines and by said pair of cuts or knurlings, hence leaving uncovered and accessible from the outside of the box at least a portion of the leaflet housed in the internal pocket of the box.

4. A box as claimed in claim 3, wherein at least part of that free edge of the end panel facing said closure panel is more distant from the first transverse folding line than said second transverse folding line.

5. A box as claimed in claim 4, wherein the free edge of the end panel facing the closure panel is profiled to present a recess which intersects said second transverse folding line.

6. A box as claimed in claim 1, wherein from at least that part of the panel which faces that end of the box through which the articles to be contained therein are inserted, there projects a flap which is rotatable about a folding line formed in said panel, such that said flap can be turned outwards from the box to define a chute which facilitates insertion of the articles into the box and prevents them interfering with the panel defining the pocket and with the illustrative leaflet housed in it.

7. A box as claimed in claim 3, wherein from at least that part of the panel which faces that end of the box through which the articles to be contained therein are inserted, there projects a flap which is rotatable about a folding line formed in said panel, such that said flap can be turned outwards from the box to define a chute which facilitates insertion of the articles into the box and prevents them interfering with the panel defining the pocket and with the illustrative leaflet housed in it.

8. A box as claimed in claim 5, wherein from at least that part of the panel which faces that end of the box through which the articles to be contained therein are inserted, there projects a flap which is rotatable about a folding line formed in said panel, such that said flap can be turned outwards from the box to define a chute which facilitates insertion of the articles into the box and prevents them interfering with the panel defining the pocket and with the illustrative leaflet housed in it.

9. A box as claimed in claim 8, wherein in the panel defining said pocket there is provided at least one hole which enables a portion of the illustrative leaflet housed in the box to be seen.

10. A sheet in the form of a single piece of punched and crease-lined cardboard or the like for forming a box having the characteristics resulting from the preceding claims.

* * * * *